US006350727B1

(12) United States Patent
Flower

(10) Patent No.: US 6,350,727 B1
(45) Date of Patent: Feb. 26, 2002

(54) NON-STREAKING NO-WIPE CLEANING COMPOSITIONS WITH IMPROVED CLEANING CAPABILITY

(75) Inventor: David M. Flower, Caledonia, MI (US)

(73) Assignee: Amway Corporation, Ada, MI (US)

( * ) Notice: Subject to any disclaimer, the term of this patent is extended or adjusted under 35 U.S.C. 154(b) by 0 days.

(21) Appl. No.: 09/493,034

(22) Filed: Jan. 28, 2000

(51) Int. Cl.[7] ..... C11D 1/74; C11D 1/66; C11D 3/30; C11D 3/20

(52) U.S. Cl. ..... 510/238; 510/199; 510/191; 510/422; 510/470; 510/506; 510/499; 134/42

(58) Field of Search ..... 510/191, 199, 510/238, 422, 470, 506, 499; 134/42

(56) References Cited

U.S. PATENT DOCUMENTS

| | | | | |
|---|---|---|---|---|
| 3,839,234 A | | 10/1974 | Roscoe | 252/544 |
| 4,025,450 A | | 5/1977 | MacMillan | 425/17 |
| 4,627,931 A | | 12/1986 | Malik | 252/153 |
| 4,822,514 A | | 4/1989 | Becker | 252/108 |
| 5,322,635 A | | 6/1994 | Hieatt et al. | 252/82 |
| 5,376,310 A | | 12/1994 | Cripe et al. | 510/356 |
| 5,451,335 A | | 9/1995 | Hieatt et al. | 252/82 |
| 5,536,452 A | | 7/1996 | Black | 252/238 |
| 5,587,022 A | | 12/1996 | Black | 134/26 |
| 5,644,041 A | | 7/1997 | Johansson | 536/4.1 |
| 5,770,549 A | | 6/1998 | Gross | 510/238 |
| 5,770,554 A | | 6/1998 | Misselyn et al. | 510/426 |
| 5,814,590 A | | 9/1998 | Sherry et al. | 510/237 |
| 5,814,591 A | | 9/1998 | Mills et al. | 510/238 |
| 5,837,664 A | | 11/1998 | Black | 510/238 |
| 5,910,474 A | | 6/1999 | Black | 510/235 |
| 5,919,745 A | | 7/1999 | Cala et al. | 510/340 |
| 5,948,741 A | | 9/1999 | Ochomogo et al. | 510/191 |
| 5,948,742 A | | 9/1999 | Chang et al. | 510/191 |
| 5,990,065 A | * | 11/1999 | Vinson et al. | 510/237 |
| 6,069,122 A | * | 5/2000 | Vinson et al. | 510/235 |
| 6,153,577 A | * | 11/2000 | Cripe et al. | 510/356 |
| 6,172,021 B1 | * | 1/2001 | Ofosu-Asante et al. | 510/237 |

FOREIGN PATENT DOCUMENTS

| | | |
|---|---|---|
| EP | 0864638 | 9/1998 |
| WO | WO 95/23202 | 8/1995 |
| WO | WO 99/64548 | 12/1999 |

OTHER PUBLICATIONS

United States Statutory Invention Registration No. H269, published May 5, 1987, Inventor: Malik.
Patent Abstract of Japan, JP 11005997 (Jan. 12, 1999).
PCT Search Report, PCT/US01/02782 (Jun. 12, 2001).

* cited by examiner

*Primary Examiner*—Gregory Delcotto
(74) *Attorney, Agent, or Firm*—Finnegan, Henderson, Farabow, Garrett & Dunner, L.L.P.

(57) ABSTRACT

An aqueous no-scrub, no-wipe cleaning composition containing at least one partial salt of EDTA and a water-soluble amine; at least one alkyl polyglycoside surfactant; at least one alkyl ether carboxylate surfactant; and up to 0.5% by weight of an ethoxylated nonionic surfactant, relative to the total weight of the composition, and a method for cleaning a soiled surface to provide a clean surface which is substantially streak-free by applying the cleaning composition to a soiled surface.

23 Claims, No Drawings

NON-STREAKING NO-WIPE CLEANING COMPOSITIONS WITH IMPROVED CLEANING CAPABILITY

FIELD OF THE INVENTION

The present invention relates to no-scrub, no-wipe compositions for use in cleaning and maintaining showers and bathtubs and other surfaces and fixtures frequently exposed to moisture and soiling, especially involving hard water. The compositions contain an effective, non-streaking surfactant system, novel chelating salts, and optionally biocidal agents to inhibit mold, fungal, and bacterial growth.

BACKGROUND OF THE INVENTION

A problem commonly encountered in bathrooms, particularly showers, tubs, and bathing facilities, is that, in the presence of hard water, lime ($CaCO_2$) and soap scum build up on surfaces and fixtures. This buildup gives surfaces an unsightly appearance and creates a good breeding environment for mold and mildew, especially in conjunction with the moist, warm conditions usually present in such places. Further, mildew, lime, soap scum, and soil, once allowed to build up over time, are difficult to remove. The person who cleans such buildup is forced to use strong cleaners and bleaches that create harsh, irritating fumes when used in the close confines of the shower or bathroom.

The market has recognized the value of effective cleaning and maintenance products designed to prevent and/or eliminate these problems, as evidenced by sales growth of this new category of products. However, the current art provides systems that that sacrifice either cleaning ability, safety, or surface appearance. Specifically, there is a need for a product which provides effective cleaning and mold control at a neutral pH while also leaving the cleaned surface with a clear, glossy, streak-free appearance. Existing products which purport to achieve these objectives at neutral pH have been found to lack the ability to effectively clean heavy soil and/or to leave hazy films or streaks on the cleaned surface. Even those products which are marketed as "streak-free" or "no dull residue" tend to leave behind iridescent films which are readily visible on chromed surfaces, and which often become hazy with extended drying (i.e., 1–24 hours).

The present invention not only solves the appearance problem (streaking, haziness) of the current art but also provides excellent cleaning at near neutral pH. In order to accomplish these goals, specific problems had to be solved by the inventor. First, although ethoxylated nonionic surfactants are generally preferred as the primary cleaning ingredient in compositions such as those of the present invention, these nonionic surfactants have the known drawback of drying to streaky or hazy films and of possibly damaging certain plastics with prolonged exposure. Second, it is known that the fatty soils found in soap scum are typically best removed by cleaning compositions at alkaline pH. In fact, the chelating agent most preferred for this type of cleaning, ethylenediamine tetraacetic acid (EDTA), is known to be most effective at moderately alkaline or even very alkaline pH (e.g., pH>9–12).

The inventor has discovered that if specific blends of nonionic surfactants, other surfactants, and chelating agents, and optionally biocides, are combined, the user can perform a no-scrub, no-wipe, streak-free cleaning treatment of surfaces at or near a neutral pH.

SUMMARY OF THE INVENTION

To achieve these and other advantages, and in accordance with the purpose of the invention as embodied and broadly described herein, the present invention, in one aspect, provides an aqueous cleaning composition comprising at least one partial salt of ethylenediamine tetraacetic acid (EDTA) and a water-soluble amine; at least one alkyl polyglycoside surfactant; at least one alkyl ether carboxylate surfactant; and up to 0.5% by weight of an ethoxylated nonionic surfactant, relative to the total weight of the cleaning composition. The inventor has found that, surprisingly, effective cleaning, i.e., resulting in a clean surface with a streak-free, non-hazy appearance and minimal reoccurrence of mold and mildew stains, can be achieved by using partial salts of EDTA and water soluble amines coupled with at least one alkyl ether carboxylate surfactant, at least one alkyl polyglycoside surfactant, and a minimum amount of ethoxylated nonionic surfactants. The EDTA-amine partial salts act as chelating agents that are surprisingly more effective than EDTA salts previously used in the art, e.g., alkali metal EDTA salts such as disodium, trisodium, dipotassium, and tripotassium EDTA. Ethoxylated nonionic surfactants, typically used in cleaning compositions for their good cleaning properties, tend to leave streaks on the cleaned surfaces. Accordingly, they are used optionally and, if used, only in a small quantity in the present invention, allowing the inventive compositions to provide excellent streak-free cleaning but still performing like cleaners with higher levels of such surfactants.

Additional objects and advantages of the invention will be set forth in part in the description which follows, and in part will be apparent from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

Reference will now be made in detail to the presently preferred embodiments of the present invention. The invention is drawn to an aqueous cleaning composition comprising at least one partial salt of EDTA and a water-soluble amine; at least one alkyl polyglycoside surfactant; at least one alkyl ether carboxylate surfactant; and up to 0.5% by weight of an ethoxylated nonionic surfactant, relative to the total weight of the cleaning composition. Preferably, the ratio of alkyl polyglycoside surfactant to total ethoxylated, ether carboxylate and other surfactants is at least 4:1.

The term "partial salt" as used herein refers to a acidic compound, e.g., EDTA, in which the degree of neutralization is at least 1, i.e., at least one of the acid groups has been neutralized. In the present invention, the preferred partial salts of EDTA have a degree of neutralization of 2 to 3.

Water soluble amines useful in the present invention include, but are not limited to, those with a crystallization/melting point near or below ambient temperature. Preferably the water soluble amines are chosen from alkanolamines and morpholine. Alkanolamines useful in the present invention include, but are not limited to, 2-amino,2-methyl-1-propanol (isobutanolamine), monoethanolamine, diethanolamine, triethanolamine, aminoethylethanolamine, methyldiethanolamine, monoisopropanolamine, monobutanolamine, and diethanol isopropanolamine. Particularly preferred is monoisopropanolamine. The at least one EDTA-amine partial salt is present in the composition of the invention in an amount ranging from 0.1 to 10 percent, preferably 0.2 to 5 percent, by weight relative to the total weight of the composition.

The EDTA-amine partial salts are partially neutralized to provide products with pH values ranging from 5 to 9. The pH may also be maintained/adjusted by the presence of a buffering agent such as, but not limited to, water-soluble organic bases including amines, ethanolamines, aminoalcohols and morpholine.

Alkyl polyglycoside (APG) surfactants useful in the present invention include, but are not limited to, those having $C_6$–$C_{18}$ alkyl chains, particularly mixtures of such surfactants. Alkyl sources include natural fats and oils such as coconut oil. The amount of glycoside present generally ranges from 1–3 moles, preferably 1–2 moles per mole of fatty alkyl. APG surfactants that can be used in the present invention are available, e.g., from the Henkel Corp. under the GLUCOPON tradename: GLUCOPON 220, GLUCOPON 425, and GLUCOPON 600. These alkyl polyglycoside surfactants are nonionic. The at least one alkyl polyglycoside surfactant is present in the composition of the invention in an amount ranging from 0.1 to 4 percent, preferably 0.125 to 2 percent, relative to the total weight of the composition.

Alkyl ether carboxylated surfactants (AECs) useful in the present invention include, but are not limited to, compounds derived from alcohol ethoxylates and having the formula $R—O—(EO)_n—CH_2—CO_2M$, wherein R is a straight or branched $C_6$–$C_{18}$ alkyl, preferably a $C_8$–$C_{14}$ alkyl, or an alkylaryl group, such as octylphenyl or nonylphenyl; EO denotes ethylene oxide; and M is either hydrogen or a metal ion. The amount of ethylene oxide varies according to the chain length of the alkyl group. Preferably, tile compounds used are derived from primary alcohol ethoxylates, but the AECs may be chosen from propylene tetramer derived alcohols, Guerbet alcohols, secondary alcohols and branched alcohols with smaller chain branches, especially methyl and ethyl branches. Alcohol alkoxylate carboxylates, based on multiple alkylene oxides such as ethylene oxide and propylene oxide, are also useful.

AECs which can be used in the present invention are available, e.g., from Hickson-DanChem Corp. under the name Neodox™ Carboxylates; from Finetex under the name Surfine™; from Clariant under the names Sandopan™ and Sandosan™; and from Albright & Wilson under the Empicol C™ series.

The at least one alkyl ether carboxylated surfactant is present in the composition of the invention in an amount ranging up to 1 percent, preferably 0.0025 to 0.4 percent, relative to the total weight of the composition.

The ethoxylated nonionic surfactants useful in the present invention include, but are not limited to, traditional cleaning agents for hard surfaces such as alcohol alkoxylates, alkylene oxide (co)polymers, ethoxylated fatty acids, alkyl alkoxylates (including both ethylene and propylene oxide), alkylphenol ethoxylates, ethoxylated amines, and mixtures thereof. The alkyl chains range in length from $C_6$–$C_{,8}$, preferably $C_8$–$C_{14}$. These ethoxylated nonionic surfactants are present in an amount up to 5 percent, preferably ranging from 0.001 to 0.5 percent, and more preferably 0.0025 to 0.2 percent by weight relative to the total weight of the composition.

Additionally, the inventive composition may contain volatile solvents, preferably hydrophilic volatile solvents, including, but not limited to, alcohols and glycol ethers such as methoxypropanol, butoxyethanol, ethylene glycol ethers, and propylene glycol ethers. Ethylene glycol ethers are available from Dow Chemical's DOWANOL E series and propylene glycol ethers from the DOWANOL P series. These volatile solvents are present in the composition of the invention in an amount ranging up to 15 percent, preferably from 2 to 10 percent, relative to the total weight of the composition.

The inventive composition may also contain nonvolatile co-solvents, including, but not limited to, alkyl pyrrolidones, citrate esters, organic carbonates, and terpenes. These nonvolatile co-solvents are present in the composition of the invention in an amount ranging up to 1 percent, preferably from 0.0025 to 0.1 percent, relative to the total weight of the composition.

Other optional ingredients are those known in the art to be useful in cleaning compositions, but which do not affect the final claimed properties of the present invention. Such ingredients include, but are not limited to, biocides, fragrances, peroxide bleaches, preservatives, soil-release agents, silicone surfactants, or fluorosurfactants.

Another aspect of the present invention is a method for cleaning a soiled surface to provide a clean surface which is substantially streak-free by applying to a soiled surface an aqueous cleaning composition as described above.

The invention will be illustrated by, but is not intended to be limited to, the following examples.

EXAMPLE 1

Comparison of Cleaning Performance

Three compositions containing disodium EDTA as the chelating agent were prepared as shown in Table 1 below. These compositions were compared with six compositions according to the present invention, prepared as shown in Table 1. Each inventive composition contained EDTA acid and an amine base in order to form the EDTA-amine partial salt as presently claimed. The comparative compositions (disodium EDTA) contained only the amount of amine base needed to adjust the pH so that all samples were similar and near neutral pH. In other words, these comparative compositions were not EDTA-amine salt compositions but predominantly sodium salt compositions.

The compositions were tested for soap scum and soil removal capability using ASTM method D-3543-97. An industry standard soil mixture (synthetic sebum-soap scum) was applied to a ceramic tile surface to form a tenacious, heavy soil deposit. The ceramic tile was then washed with each individual composition using a standard scrubbing apparatus. The results are shown as % detergency at the bottom of Table 1. It is noted that, for actual use, the inventive compositions are diluted with water in a ratio of concentrated composition to water ranging from about 1:2 to 1:10. Table 1 shows the ingredients as present in the undiluted form, but shows the detergency values for formulations diluted with water in a 1:4 ratio of composition to water.

The higher the % detergency, the better the cleaning performance rating. As can be seen from the table, the inventive compositions gave markedly higher (almost double in some cases) detergency results than the disodium EDTA compositions.

TABLE 1

(Note: all ingredients are listed in % by weight)

| | $Na_2$ EDTA Compositions (Comparative) | | | Inventive Compositions | | | | | |
|---|---|---|---|---|---|---|---|---|---|
| EDTA acid | — | — | — | 1.7 | 1.7 | 1.5 | 1.7 | 1.7 | 1.7 |
| Disodium EDTA | 2.5 | 2.5 | 2.5 | — | — | — | — | — | — |
| Base type | MOR[1] | MOR | AMP[2] | TEA[3] | AMP | TEA | AMP | MIPA[4] | AEEA[5] |
| Base amount | 0.5 | 0.5 | 0.5 | 2.0 | 1.7 | 1.3 | 1.5 | 1.1 | 0.8 |
| Alkyl polyglycoside | 0.75 | 1.5 | 1.5 | 1.5 | 1.5 | 1.5 | 1.7 | 1.7 | 1.7 |
| Alkyl ether carboxylic acid | 0.2 | 0.2 | 0.2 | 0.2 | 0.2 | 0.2 | 0.2 | 0.2 | 0.2 |
| $C_8$7-EO alcohol ethoxylate | — | 0.1 | 0.1 | 0.1 | 0.1 | 0.1 | 0.1 | 0.1 | 0.1 |
| $C_{12}$ Methyl ester ethoxylate | 0.1 | — | — | — | — | — | — | — | — |
| Phospho Quat CDM | 0.25 | 0.1 | 0.1 | 0.1 | 0.1 | 0.1 | 0.1 | 0.1 | 0.1 |
| Fragrance | 0 | 0.1 | 0.1 | 0.1 | 0.1 | 0.1 | 0.1 | 0 | 0 |
| Methoxypropanol | 9.5 | 9.5 | 9 5 | 9.5 | 9.5 | 9.5 | 9.5 | 9.5 | 9.5 |
| Water | qs | qs | qs | qs | qs | qs | qs | qs | qs |
| pH | 6.1 | 6.3 | 7.5 | 5.77 | 6.45 | 4.87 | 6.1 | 6.1 | 6.1 |
| Sebum-Soap Scum Detergency | 45 | 57.7 | 647 | 93.7 | 82.2 | 83.1 | 83.7 | 95.9 | 87.5 |

[1]MOR = morpholine
[2]AMP = 2-amino, 2-methyl-1-propanol
[3]TEA = triethanolamine
[4]MIPA = monoisopropanolamine
[5]AEEA = aminoethylethanolamine

EXAMPLE 2

Comparison of Streaking, Detergency, and No-Scrub Cleaning Performance

Ten inventive compositions, i.e., compositions containing partial EDTA-amine salts coupled with the inventive combination of surfactants, were compared with one composition containing disodium EDTA and with six commercially available no-scrub, no-wipe, and/or streak-free cleaners. The compositions were tested in three categories: streaking, scrub cleaning (soap scum and soil removal capability when scrubbing is used as the cleaning method), and no-scrub cleaning. The inventive compositions were tested in the ready-to-use-form, i.e., a concentrate diluted with water in a ratio of concentrate to water of about 1:4.

Streaking was measured by applying a composition to be tested onto a ceramic tile surface and allowing it to dry. Observations were made at regular intervals to check for streaking, hazing, formation of film, or other visual irregularities. The level of streaking was rated from 1 to 5, with 1 denoting very heavy streaking, 3 denoting marginal streaking, and 5 denoting no streaking at all. Streak ratings of 4 or better after 24 hours are considered very good.

Regular scrub cleaning was carried out using ASTM method D-3543-97, as described in Example 1, and the results are shown as % detergency. As in Example 1, the higher the % detergency, the better the performance rating.

Finally, no-scrub cleaning was carried out by applying soap to a black ceramic tile, drying the tile, then applying hard water and drying again. This process was repeated for 10 cycles to build up a moderately heavy natural soap scum on the tile surface. A cleaning composition was then applied to the soiled surface and allowed to drain and dry naturally with the tile in a vertical, upright position. The tile was then rinsed under gently running water with no other mechanical action. This mirrors the practical use of a no-scrub and no-wipe product, where daily showering activity after cleaning removes any remaining residue. The tile was then evaluated both visually and using a gloss meter. The visual ratings were made on a scale of 1 to 5, with 1 and 2 being considered failures (ie., soil not removed), 3 being borderline or marginal (soil partially removed), 4 denoting substantial removal or a "good" rating, and 5 denoting "excellent" cleaning (i.e., no or substantially no remaining soil). The baseline for the no-scrub results was a soiled black ceramic tile that was not cleaned at all.

The gloss readings were made with a Hunterlab ProGloss gloss meter model # PRO-60 or PRO-3. Each composition was simultaneously evaluated at 20°, 60°, and 85° angles. The 20° and 60° readings are the most sensitive. At an 85° angle, it is harder for even the gloss meter to register as accurate a measurement as the human eye, since it cannot detect film and streaks as well at this angle.

The results of these tests are shown in Table 2 below.

TABLE 2

| | STREAKING | | | | | | | NO SCRUB CLEANING | | | |
|---|---|---|---|---|---|---|---|---|---|---|---|
| | | | | | | | | | Gloss meter readings | | |
| | Initial | 1 hr | 4 hrs | 12 hrs | 24 hrs | 48 hrs | DETERGENCY | Visual | 20° | 60° | 85° |
| EDTA salts | | | | | | | | | | | |
| (Baseline) | 5.0 | 5.0 | 5.0 | 5.0 | 5.0 | 5.0 | 0 | 1 | 24.3 | 40.9 | 70.0 |
| $Na_2$EDTA (comparative) | 5.0 | 5.0 | 5.0 | 5.0 | 5.0 | 5.0 | 57.7 | 4.5 | 93.8 | 96.8 | 99.3 |
| AMP | 5.0 | 5.0 | 5.0 | 5.0 | 4.5 | 3.0 | 90.0 | 5.0 | 91.6 | 91.8 | 95.8 |
| MIPA | 5.0 | 5.0 | 5.0 | 5.0 | 5.0 | 4.0 | 93.8 | 5.0 | 108.0 | 102.4 | 94.4 |
| DEIPA* | 5.0 | 5.0 | 4.5 | 4.0 | 4.0 | 3.0 | 87.1 | 5.0 | 97.4 | 99.1 | 97.6 |

TABLE 2-continued

| | STREAKING | | | | | | | NO SCRUB CLEANING | | | |
|---|---|---|---|---|---|---|---|---|---|---|---|
| | | | | | | | | | Gloss meter readings | | |
| | Initial | 1 hr | 4 hrs | 12 hrs | 24 hrs | 48 hrs | DETERGENCY | Visual | 20° | 60° | 85° |
| MBA** | 5.0 | 5.0 | 5.0 | 5.0 | 5.0 | 4.0 | 93.3 | 5.0 | 95.9 | 98.3 | 98.5 |
| AEEA | 5.0 | 4.5 | 4.5 | 4.5 | 4.5 | 4.0 | 87.5 | 3.5 | 94.7 | 97.9 | 101.9 |
| MEA*** | 4.5 | 4.5 | 4.5 | 4.5 | 4.5 | 3.5 | 92.5 | 5.0 | 100.9 | 99.6 | 101.3 |
| DEA**** | 5.0 | 5.0 | 5.0 | 5.0 | 5.0 | 4.0 | | 5.0 | 98.3 | 95.6 | 98.5 |
| MDEA***** | 5.0 | 5.0 | 5.0 | 5.0 | 5.0 | 4.0 | 82.4 | 5.0 | 98.5 | 99.3 | 100.1 |
| TEA | 5.0 | 5.0 | 5.0 | 5.0 | | 3.0 | 85.2 | 5.0 | 96.5 | 98.5 | 99.5 |
| Morpholine | 5.0 | 5.0 | 5.0 | 5.0 | 5.0 | 2.5 | 83.1 | 5.0 | 91.3 | 98.5 | 99.7 |
| Commercial Products | | | | | | | | | | | |
| PRODUCT A | 4.0 | 4.0 | — | 3.5 | 3.5 | 3.5 | 99.1 | 2.0 | 72.6 | 80.8 | 94.9 |
| PRODUCT B | 5.0 | 4.5 | — | 4.0 | 3.5 | 3.0 | 98.8 | 5.0 | 94.2 | 100.3 | 99.2 |
| PRODUCT C | 4.0 | 4.0 | — | 4.0 | 4.0 | 4.0 | 99.2 | 2.5 | 91.4 | 93.1 | 93.0 |
| PRODUCT D | 1.0 | 1.0 | — | 1.0 | 1.0 | 1.0 | 39.1 | 4.5 | 98.5 | 99.8 | 98.6 |
| PRODUCT E | 5.0 | 4.5 | — | 2.0 | 1.5 | 1.5 | 100.0 | 5.0 | 101.2 | 100.1 | 99.7 |
| PRODUCT F | 3.5 | 3.5 | — | 3.5 | 3.5 | 3.5 | 39.8 | 2.0 | 65.9 | 72.6 | 93.7 |

STREAKING:
5 = No Streaking
3 = Marginal Streaking
1 = Very Heavy Streaking
CLEANING: (Visual)
5 = Completely clean
4 = Substantially clean
3 = Marginally clean
1, 2 = Failure to clean
*DEIPA = diethanol isopropanolamine
**MBA = monobutanolamine
***MEA = monoethanolamine
****DEA = diethanolamine
*****MDEA = methyldiethanolamine It is clear from the results shown in Table 2 that the inventive compositions are superior to the disodium EDTA formulation and to the commercial products. None of the comparative products showed superior results in all three categories. For instance, although the disodium EDTA formulation did extremely well in the streaking test and quite well in the no scrub cleaning category (for both visual and gloss meter measurements), its detergency value was quite low (under 60%).

As for the commercial products, only Product C gave a streaking value of 4.0 or higher after 24 hours, whereas the others were all 3.5 or lower. Product E had a streaking value of 2.0 after only 12 hours, and Product D had unacceptable streaking values (1.0) from the beginning. Despite its higher streaking value and apparently respectable gloss meter readings, however, Product C had a low visual rating for the no-scrub cleaning. Products A and F had lower gloss meter readings than Product C but also had low visual ratings. It is important to consider both the visual and instrumental readings for the no-scrub category since the human eye and the gloss meter may detect soil on the test tile differently. Finally, as far as detergency, Products D and F had unacceptable detergency values of less than 40%. Thus, only the inventive products were able to provide both good cleaning (scrub and no-scrub) and a streak-free surface, even for periods up to 48 hours. None of the comparative prior art compositions was able to achieve this combination of results.

It will be apparent to those skilled in the art that various modifications and variations can be made in the compositions and methods of the present invention without departing from the spirit or scope of the invention. Thus, it is intended that the present description cover the modifications and variations of this invention provided that they come within the scope of the appended claims and their equivalents.

What is claimed is:

1. An aqueous cleaning composition comprising (a) at least one partial water-soluble amine salt of EDTA in an amount from 0.1 to 10 percent by weight relative to the total weight of the composition;

(b) at least one alkyl polyglycoside surfactant in an amount from 0.1 to 4 percent by weight relative to the total weight of the composition;

(c) at least one alkyl ether carboxylate surfactant in an amount greater than 0 percent to 1 percent by weight relative to the total weight of the composition; and (d) up to 0.5% by weight of an ethoxylated nonionic surfactant, relative to the total weight of said composition.

2. A cleaning composition according to claim 1, wherein said at least one alkyl polyglycoside surfactant is present in a ratio of at least 4:1 with all other surfactants present in said composition.

3. A cleaning composition according to claim 1, wherein said composition has a pH ranging from 5 to 9.

4. A cleaning composition according to claim 1, wherein said water soluble amine is chosen from alkanolamines and morpholine.

5. A cleaning composition according to claim 4, wherein said alkanolamines are chosen from monoethanolamine, diethanolamine, triethanolamine, methyldiethanolamine, aminoethylethanolamine, 2-amino, 2-methyl-1-propanol, monobutanolamine, diethanol isopropanolamine, and monoisopropanolamine.

6. A cleaning composition according to claim 4, wherein said water-soluble amine is monoisopropanolamine.

7. A cleaning composition according to claim 1, further comprising a biocicie.

8. A cleaning composition according to claim 1, wherein said at least one partial water-soluble amine salt of EDTA is present in said composition in an amount ranging from 0.1 to 10 percent by weight relative to the total weight of the composition.

9. A cleaning composition according to claim 8, wherein said at least one partial water-soluble amine salt of EDTA is present in said composition in an amount ranging from 0.2 to 5 percent by weight relative to the total weight of the composition.

10. A cleaning composition according to claim 1, wherein said at least one alkyl polyglycoside surfactant is present in said composition in an amount ranging from 0.125 to 2 percent relative to the total weight of the composition.

11. A cleaning composition according to claim 1, wherein said at least one alkyl ether carboxylated surfactant is present in said composition in an amount ranging from 0.0025 to 0.4 percent relative to the total weight of the composition.

12. A cleaning composition according to claim 1, wherein said ethoxylated nonionic surfactant is present in said composition in an amount ranging from 0.001 to 0.5 percent relative to the total weight of the composition.

13. A cleaning composition according to claim 12, wherein said ethoxylated nonionic surfactant is present in said composition in an amount ranging from 0.0025 to 0.2 percent relative to the total weight of the composition.

14. A cleaning composition according to claim 1, further comprising at least one volatile solvent.

15. A cleaning composition according to claim 14, wherein said at least one volatile solvent is present in said composition in an amount ranging up to 15 percent relative to the total weight of the composition.

16. A cleaning composition according to claim 15, wherein said at least one volatile solvent is present in said composition in an amount ranging from 2 to 10 percent relative to the total weight of the composition.

17. A cleaning composition according to claim 14, further comprising at least one nonvolatile co-solvent.

18. A cleaning composition according to claim 17, wherein said at least one nonvolatile co-solvent is present in said composition in an amount ranging up to 1 percent relative to the total weight of the composition.

19. A cleaning composition according to claim 18, wherein said at least one nonvolatile co-solvent is present in said composition in an amount ranging from 0.0025 to 0.1 percent relative to the total weight of the composition.

20. A method for cleaning a soiled surface to provide a clean surface which is substantially streak-free, said method comprising applying to a soiled surface an aqueous cleaning composition comprising (a) at least one partial water-soluble amine salt of EDTA in an amount from 0.1 to 10 percent by weight relative to the total weight of the composition;

(b) at least one alkyl polyglycoside surfactant in an amount from 0.1 to 4 percent by weight relative to the total weight of the composition;

(c) at least one alkyl ether carboxylate surfactant in an amount greater than 0 percent to 1 percent by weight relative to the total weight of the composition; and (d) up to 0.5% by weight of an ethoxylated nonionic surfactant, relative to the total weight of said composition.

21. A ready to use cleaning composition comprising water and a concentrate comprising:

(a) at least one partial water-soluble amine salt of EDTA in an amount from 0.1 to 10 percent by weight relative to the total weight of the composition;

(b) at least one alkyl polyglycoside surfactant in an amount from 0.1 to 4 percent by weight relative to the total weight of the composition;

(c) at least one alkyl ether carboxylate surfactant in an amount greater than 0 percent to 1 percent by weight relative to the total weight of the composition; and (d) up to 0.5% by weight of an ethoxylated nonionic surfactant, relative to the total weight of said composition, wherein the ratio of said concentrate to water ranges from about 1:2 to 1:10.

22. An aqueous cleaning composition for a soiled surface comprising (a) at least one partial water-soluble amine salt of EDTA in an amount from 0.1 to 10 percent by weight relative to the total weight of the composition;

(b) at least one alkyl polyglycoside surfactant in an amount from 0.1 to 4 percent by weight relative to the total weight of the composition;

(c) at least one alkyl ether carboxylate surfactant in an amount greater than 0 percent to 1 percent by weight relative to the total weight of the composition; and (d) up to 0.5% by weight of an ethoxylated nonionic surfactant, relative to the total weight of said composition, wherein said water-soluble amine is chosen from water-soluble amines capable of providing streaking resistance to said surface such that said surface is substantially streak-free for greater than 24 hours.

23. A cleaning composition according to claim 22, wherein said water-soluble amines are chosen from monoethanolamine, diethanolamine, aminoethylethanolamine, methyidiethanolamine, monoisopropanolamine, and monobutanolamine.

* * * * *

UNITED STATES PATENT AND TRADEMARK OFFICE

CERTIFICATE OF CORRECTION

PATENT NO. : 6,350,727 B1
DATED : February 26, 2002
INVENTOR(S) : David M. Flower It is certified that error appears in the above-identified patent and that said Letters Patent is hereby corrected as shown below:

Column 8,
Line 65, “biocicie” should read -- biocide --.

Column 10,
Line 49, “methyidiethanolamine” should read -- methyldiethanolamine --.

Signed and Sealed this

First Day of October, 2002

*Attest:*

*Attesting Officer*

JAMES E. ROGAN
*Director of the United States Patent and Trademark Office*